US007789762B2

(12) United States Patent
Greger et al.

(10) Patent No.: US 7,789,762 B2
(45) Date of Patent: Sep. 7, 2010

(54) CHILD MOTION DEVICE

(75) Inventors: Jeff Greger, Lititz, PA (US); Nicholas Efthermios Papageorge, Upper Darby, PA (US)

(73) Assignee: Graco Children's Products Inc., Exton, PA (US)

( * ) Notice: Subject to any disclaimer, the term of this patent is extended or adjusted under 35 U.S.C. 154(b) by 978 days.

(21) Appl. No.: 11/556,493

(22) Filed: Nov. 3, 2006

(65) Prior Publication Data

US 2007/0129156 A1 Jun. 7, 2007

Related U.S. Application Data

(60) Provisional application No. 60/732,640, filed on Nov. 3, 2005.

(51) Int. Cl.
*A63G 9/16* (2006.01)

(52) U.S. Cl. ..... 472/119; 472/118

(58) Field of Classification Search ..... 472/118–125; 297/273, 274, 284

See application file for complete search history.

(56) References Cited

U.S. PATENT DOCUMENTS

| | | | |
|---|---|---|---|
| 43,972 | A | 8/1864 | Coldwell |
| 100,083 | A | 2/1870 | Stephan |
| 616,697 | A | 12/1898 | Cowles et al. |
| 1,360,495 | A | 11/1920 | Bugenhagen |
| 1,707,167 | A | 3/1929 | Marshall |
| 1,731,658 | A | 10/1929 | Gnuechtel |
| 1,874,345 | A | 8/1932 | Parrott |
| 2,371,384 | A | 3/1945 | Dyer, Jr. |
| 2,506,890 | A | 5/1950 | Pratt |
| 2,510,223 | A | 6/1950 | Hart |
| 2,616,485 | A | 11/1952 | Robbins |
| 2,704,111 | A | 3/1955 | Wunderlich |
| 3,147,972 | A | 9/1964 | Borsuk |
| 3,391,932 | A | 7/1968 | Scalf |
| 3,829,086 | A | 8/1974 | Lelong |
| 4,155,548 | A | 5/1979 | Smith et al. |
| 4,226,467 | A | 10/1980 | Boudreau |
| 4,258,446 | A | 3/1981 | McAllister |
| 4,620,334 | A | 11/1986 | Robinson |

(Continued)

FOREIGN PATENT DOCUMENTS

DE 2421474 11/1975

(Continued)

OTHER PUBLICATIONS

Fisher-Price Nature's Touch Baby Papasan Cradle Swing, Product # G2609, 2006; 2 pages; www.fisher-price.com.

(Continued)

*Primary Examiner*—Kien T Nguyen
(74) *Attorney, Agent, or Firm*—Lempia Braidwood LLC

(57) ABSTRACT

A child motion device has a frame assembly configured to rest on a floor surface. The device also has a drive system that drives a swing assembly. The swing assembly can include a pair of swing arms having proximal ends and distal ends. The distal ends support a child seat assembly. The distance between the distal ends relative to the distance between proximal ends is adjustable, thereby adjusting at least one motion characteristic of the device. The adjustable motion characteristics can include a gliding motion and a swinging motion.

17 Claims, 6 Drawing Sheets

U.S. PATENT DOCUMENTS

| | | | | |
|---|---|---|---|---|
| 4,805,902 | A | | 2/1989 | Casagrande |
| 4,911,499 | A | | 3/1990 | Meeker |
| 5,303,433 | A | | 4/1994 | Jang |
| 5,403,239 | A | | 4/1995 | Zimmers |
| 5,451,093 | A | | 9/1995 | Petrie et al. |
| 5,562,548 | A | * | 10/1996 | Pinch et al. ..... 472/119 |
| 5,688,211 | A | | 11/1997 | Myers |
| 5,707,294 | A | | 1/1998 | Fischer |
| 5,803,817 | A | | 9/1998 | Stern |
| 5,833,545 | A | | 11/1998 | Pinch et al. |
| 6,027,409 | A | | 2/2000 | Favorito et al. |
| 6,254,490 | B1 | | 7/2001 | Lawson et al. |
| 6,318,803 | B1 | | 11/2001 | Garland |
| 6,343,994 | B1 | | 2/2002 | Clarke |
| 6,574,806 | B1 | | 6/2003 | Maher |
| 6,811,217 | B2 | | 11/2004 | Kane et al. |
| 6,854,799 | B1 | | 2/2005 | Asbach et al. |
| 6,932,709 | B1 | | 8/2005 | Gubitosi et al. |
| 2002/0113469 | A1 | | 8/2002 | Stern et al. |
| 2005/0101219 | A1 | | 5/2005 | Paesang et al. |
| 2006/0012230 | A1 | | 1/2006 | Kennedy et al. |
| 2007/0040431 | A1 | | 2/2007 | Bapst et al. |

FOREIGN PATENT DOCUMENTS

| | | |
|---|---|---|
| DE | 3834934 | 4/1990 |
| GB | 1163624 | 9/1969 |
| GB | 2312374 | 10/1997 |
| JP | 48068367 | 9/1973 |
| JP | 60014819 | 1/1985 |
| WO | WO 03/079861 | 10/2003 |
| WO | WO 2006/096712 | 9/2006 |

OTHER PUBLICATIONS

International Search Report and Written Opinion issued in corresponding International application No. PCT/US2006/060515 mailed Jul. 7, 2008.

International Preliminary Report on Patentability issued in related International application No. PCT/US2006/060515 mailed Jul. 29, 2008.

English translation of JP 48-68637.

English translation of DE 2421474.

* cited by examiner

CHILD MOTION DEVICE

RELATED APPLICATION DATA

This patent claims priority benefit of U.S. Provisional Patent Application Ser. No. 60/732,640, filed on Nov. 3, 2005, the contents of which are incorporated herein by reference.

BACKGROUND OF THE INVENTION

1. Field of the Disclosure

The present disclosure is generally directed to child motion devices, and more particularly to a device for supporting a child and imparting a soothing motion to the child.

2. Description of Related Art

Child motion devices such as conventional pendulum swings and bouncers are known in the art. These types of devices are often used to entertain and, sometimes more importantly, to sooth or calm a child. A child is typically placed in a seat of the device and then the device is used to swing the child in a reciprocating pendulum motion. In the case of a bouncer, a child is placed in the seat and vertical oscillating movement of the child results from the child's own movement or external force applied to the seat by someone else such as a parent.

Research has shown that many babies or children are not soothed or calmed down by these types of motion, but that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions.

Many types of child motion devices are known that are not readily and compactly foldable for storage or stowing away. Additionally, currently known child motion devices do not typically enable multiple different optional seating positions and arrangements for the child or optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child. Additionally, the drive takes up space above the seat, which can make it difficult for an adult to position a child in the device.

Other alternative motion devices are known as well. For example, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. Its seat moves in a manner such that a component of its travel path includes a side-to-side arcuate path in a somewhat horizontal plane (see FIG. 9 of the patent). U.S. Pat. No. 6,343,994 discloses another child swing wherein The base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

What is therefore needed is a child motion device that provides a motion characteristic not achieved by conventional motion devices.

SUMMARY

In accordance with one aspect of the present invention, a child motion device includes a frame supported by a surface, and a swing assembly supported by the frame at a location spaced from the support surface. A child seat assembly is supported by the swing assembly for movement thereon. The swing assembly has a motion characteristic capable of including an adjustable gliding component and an adjustable swinging component. The swing assembly drives the child seat assembly along a travel path having the motion characteristic.

It should be appreciated that the foregoing and other aspects of the invention will appear from the following description. In the description, reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the fill scope of the invention.

BRIEF DESCRIPTION OF THE DRAWINGS

Objects, features, and advantages of the present invention will become apparent upon reading the following description in conjunction with the drawing figures in which like reference numerals are intended to represent like elements throughout, and in which.

DETAILED DESCRIPTION OF THE DISCLOSURE

A number of examples are disclosed herein of alternative motion devices for soothing, calming, and/or entertaining children. The disclosed child motion devices solve or improve upon one or more of the problems or difficulties noted above with respect to known motion devices. The disclosed alternative motion devices each generally include a frame assembly that supports a pair of generally vertically supported, oscillating swing arms. The swing arms move a child seat or other child carrying or supporting device through an orbit segment or travel arc that lies in a plane that can be perpendicular to a reference plane defined by a floor surface or tilted or angled slightly relative to the reference plane. In one mode, the swing arms impart a motion to the child seat or other child carrying or supporting device that has a swinging component. In another mode, the swing arms impart a motion to the child seat or other child carrying or supporting device that has a gliding component in which the orientation of the child carrying or supporting device stays substantially constant. In the disclosed examples, at least one of the swing arms has a driven end coupled to a drive system that reciprocally moves the support arms through their travel path.

In one example, the distal or free ends of the support arms are configured to accept and support the child seat or other device above the ground surface. In one example, the swing arm can support a child seat holder that cooperates with the child seat to permit setting the child seat on the alternative motion device in more than one optional seat orientation. In this way, a child seated in the seat can experience a variety of different motions. In another example, the seat holder can be specifically configured to accept and support a seat or other child carrying device from another product, such as a car seat.

The terms generally, substantially, and the like as applied herein with respect to vertical or horizontal orientations of various components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Figure 1:
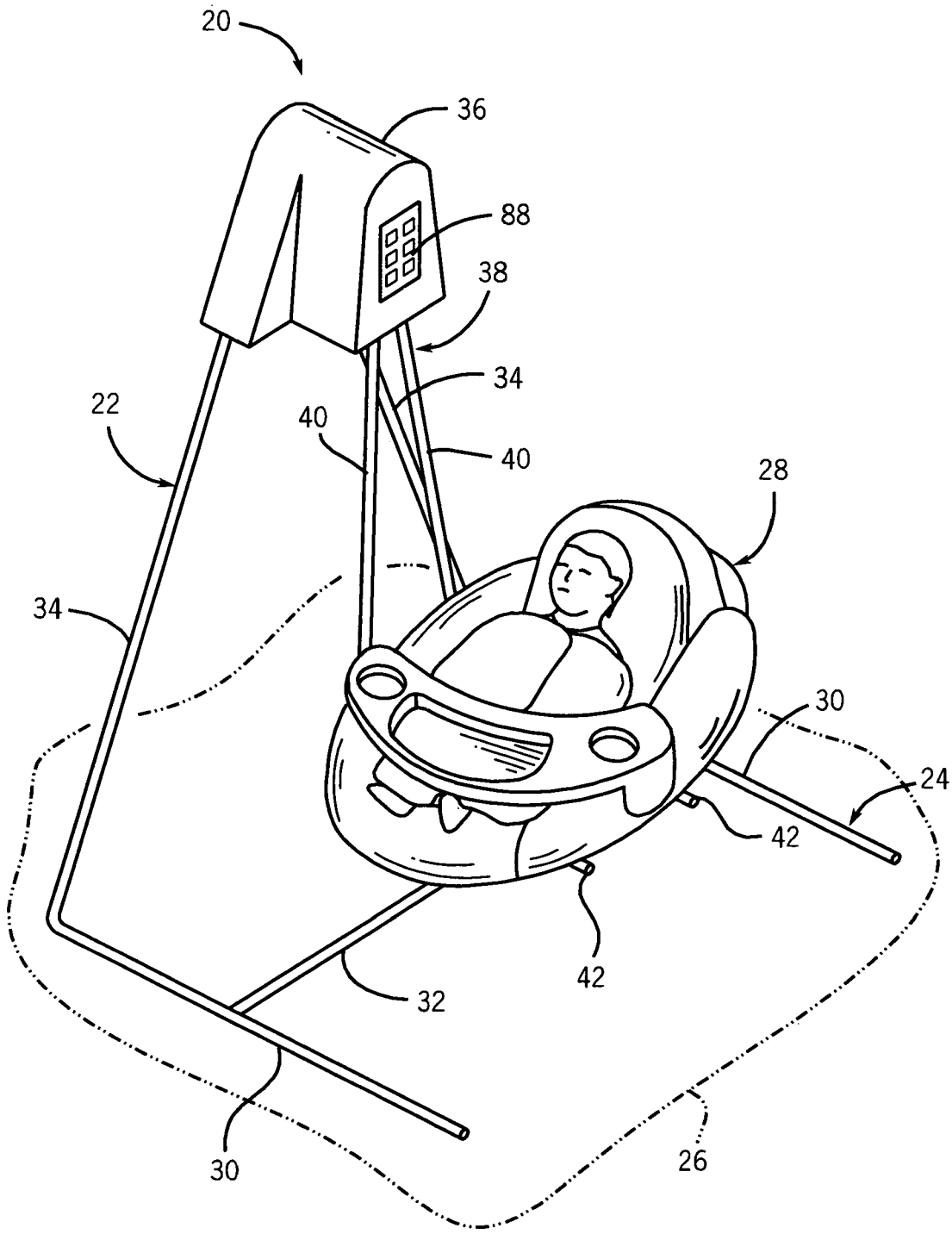
FIG. 1 is a perspective view of a child motion device having a pair of linkages supporting a child seat assembly as constructed in accordance with the teachings of the present invention.

The various components of the child motion device 20 shown in FIG. 1 and the various alternative embodiments of child motion devices described herein can vary considerably and yet fall within the spirit and scope of the present invention. A small number of examples are disclosed to illustrate the nature and variety of component configurations.

In the example illustrated in FIG. 1, one example of a child motion device 20 constructed in accordance with the teachings of the present invention is illustrated. The device 20 in this example generally includes a supporting base section 24 configured to rest on a floor surface 26, and a frame 22 extending up from the base section. The frame 22 defines an upper end that supports a swing assembly 38 which, in turn, movably supports a child seat assembly 28 such that the child seat assembly 28 can move through an orbit segment or travel arc in an oscillating fashion. The seat assembly is capable of having its motion defined by two components. The first is a swinging component whereby the angular orientation of the child seat assembly relative to the floor surface 26 changes with the angular movement of the swing assembly 38 during the oscillating motion, and the second is a gliding component whereby the orientation of the seat assembly 28 is substantially constant relative to a reference plane during the oscillating motion. The proportion of swinging and gliding motion components that contribute to the overall movement of the child seat assembly 28 can be adjustable.

Throughout this detail description, the terms "floor surface" and "reference plane" are utilized to define both a surface on which the device 20 rests and a reference for comparison to other aspects and parts of the invention for ease of description. However, the invention is not intended to be limited to use with only a specifically horizontal orientation of either the base section 24 or the reference plane. Instead, the floor surface 26 and the reference plane are utilized to assist in describing relationships between the various components of the device 20, it being appreciated that the device 20 could, for instance, instead be supported by a surface that defines an angle with respect to the horizontal, for instance a vertical wall.

The base section 24 of the child motion device 20 shown in FIG. 1 can assume a pair of parallel bars, beams, tubes, rails or other support members 30 that can be joined substantially by one or more crossbeams 32 to provide stability to the base section 24. As illustrated, a single cross beam 32 is connected between the support members 30 approximately at the midpoints of the support members. The frame 22 is illustrated as an upright A-frame including a pair of angled posts 34 that are spaced at their lower ends and converge toward their upper ends. The lower ends of the posts 34 are joined to the respective support members 30 such that the support members 30 extend forward from the posts 34.

As illustrated, the posts 34 are integral with the support members 30, though the present invention is not to be construed as limited to the illustrated embodiment. Specifically, the base section 24 can assume any one of a virtually infinite number of configurations suitable to adequately support the remainder of the child motion device 20 on the floor surface 26. Alternatively, the base section 24 can be replaced by any alternative support member that can rest on a floor surface 26 as illustrated or be cantilevered from any suitable support structure. Likewise, while the frame is illustrated as including the posts 34 that assume the shape of an A-frame, the frame 22 can assume any one of a virtually infinite number of configurations that allow the child seat assembly 28 to movably depend from a structure having a desired predetermined height.

The frame 22 further includes a casing 36 that joins and protects the upper ends of the converging posts 34. The casing 36 can be ornamental, functional, or both, and can be removable to access the inner workings of the device 20 if needed. The casing 36 extends slightly forward from the posts 34 further supports the swing assembly 38 which, in turn, supports the child seat assembly 28.

Figure 2:
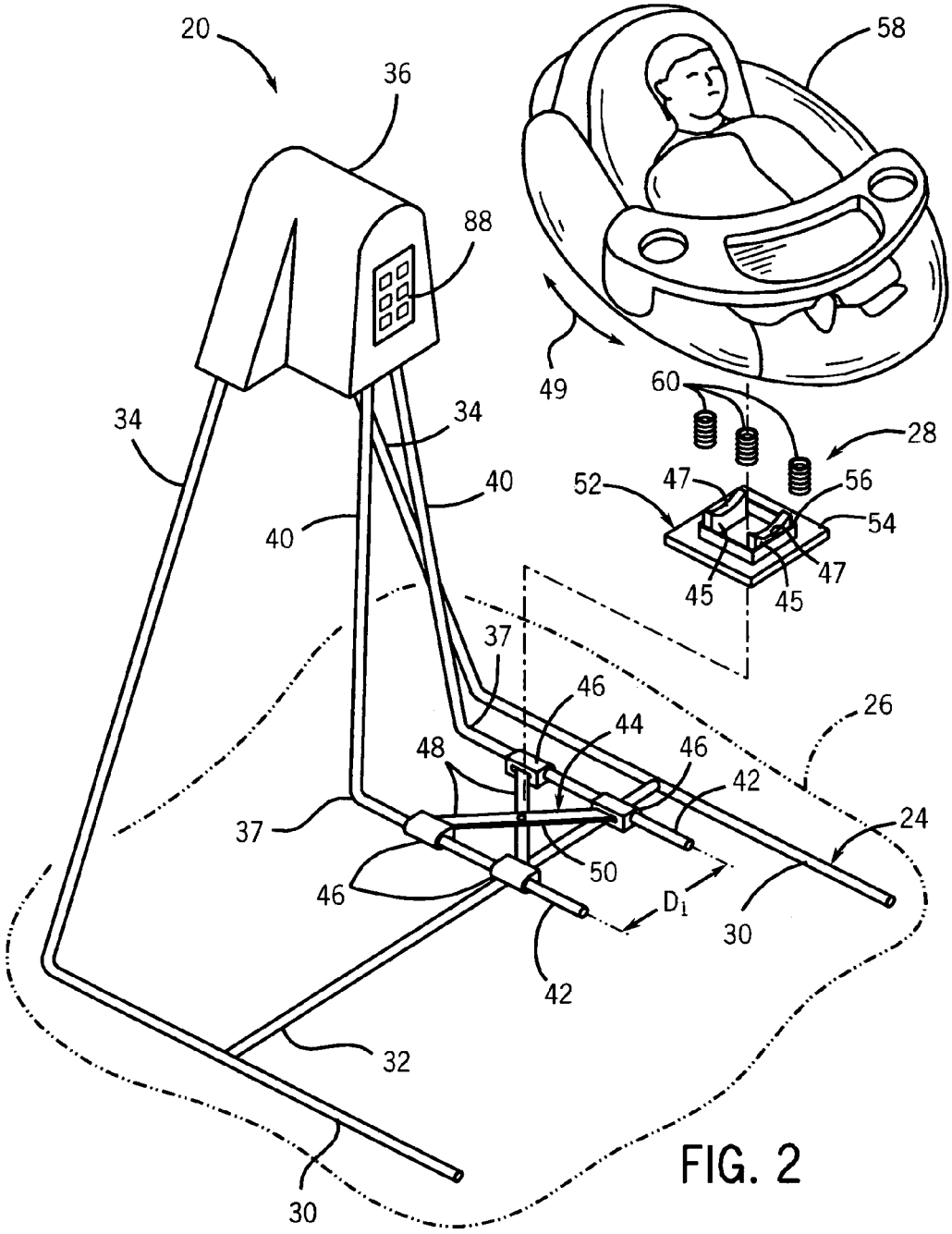
FIG. 2 is an exploded assembly view of the child seat assembly illustrated in FIG. 1.

Referring also to FIG. 2, the swing assembly 38 includes first and second swing arms 40 that have proximal ends 35 (see FIG. 5) supported within the casing 36. The swing arms 40 extend downwardly from their proximal ends at an adjustable angle relative to the vertical, as will be described in more detail below, and terminate at their distal ends 37, which are connected to a pair of spaced seat support arms 42. The distal ends 37 are thus horizontally spaced a distance $D_1$. The seat support arms 42 extend forward from the distal, or lower, end of the swing arms 40 and are suspended above the support surface 26. The seat support arms 42 can be discretely connected to the swing arms 40 or, as illustrated, can be formed integrally with the swing arms 40.

It should be appreciated that the distal ends 37 of the swing arms 40 define the locations on the swing arms 40 that support the child seat assembly 28, and that the distance $D_1$ is therefore defined as the distance between the distal ends 37. However, if the child seat assembly were supported by the swing arms 40 at a location other than at the distal ends 37, then the distance D1 would be based on the distance between the locations on the swing arms 40 that support the child assembly 28. For the purposes of this disclosure, the distal end 37 is defined as a location on a swing arm 40 that at least partially supports the child assembly 28.

A spacer member 44, illustrated as a coupler, is connected between the seat support arms 42 and maintains the seat support arms 42, and thus the distal ends of the swing arms 40, at an adjustable predetermined distance from each other. The spacer member 44 includes two pair of slider members 46 that are mounted onto the seat support arms 42 and can be manually slid along the support arms 42 to a desired position, and a pair of spacer bars 48 that are connected between diagonally opposing slider members 46 such that the spacer bars 48 define an angle less than 90 degrees with respect to the support arms 42. The spacer bars 48 are pivotally connected to the slider members, and further intersect at a pivot joint 50, which can include a pin, hinge, or other like mechanism. The spacer bars 48 can thus pivot relative to the slider members 46 to which they are attached, and can further pivot relative to each other. The support arms 42 are also rotatable within the slider members 46.

In accordance with an alternative embodiment, each pair of slider members 46 on a given support arm 42 can include one slider member 46 that is locked in a stationary position. Specifically, the position of both slider members 46 disposed proximal to the distal ends 37 of the swing arms 40 can be fixed, or the position of both slider members 46 disposed proximal to the free end of the support arms 42 can be fixed. The other slider members 46 can be slid along the support arms 42 in the manner described above.

The seat assembly 28 includes a seat holder 52 that provides a motion transmission device between the frame 22 the child seat 58. The seat holder 52 can be integrated into the swing frame, the child seat 58, or can be a member separate from but operably connected to the frame 22 and the child seat 58. While the seat holder 52 is enumerated and described herein, it should be appreciated that other structure forming part of the device 20 can also serve as a seat holder as broadly defined herein.

In one example, the seat holder 52 can, for instance, be mounted onto the pivot joint 50 such that the spacer bars 48 are free to pivot below the seat holder 52. The seat holder 52 includes a base plate 54 and a swivel plate 56 rotatably supported on the upper surface of the base plate 54. The swivel plate 56 supports a pair of spaced supports 45 that define curved upper surfaces 47 that are configured to receive the bottom surface of the child seat 58 such that the child seat is nested within the upper surfaces 47. As configured, the child seat 58 can recline fore and aft about a horizontal axis extending perpendicularly between the spaced supports, as indicated by Arrow 49. Alternatively, or additionally, the seat back can recline relative to the seating surface. One or more springs 60, which can be traditional coil springs or any alternative structure having a desired spring constant, can be connected between the seat holder 52 and the child seat 58 such that the child seat can travel vertically (or bounce) during operation of the device 20. Alternatively, the child seat 58 can be connected to the swivel plate 56 without an interposed spring member.

Figure 3:
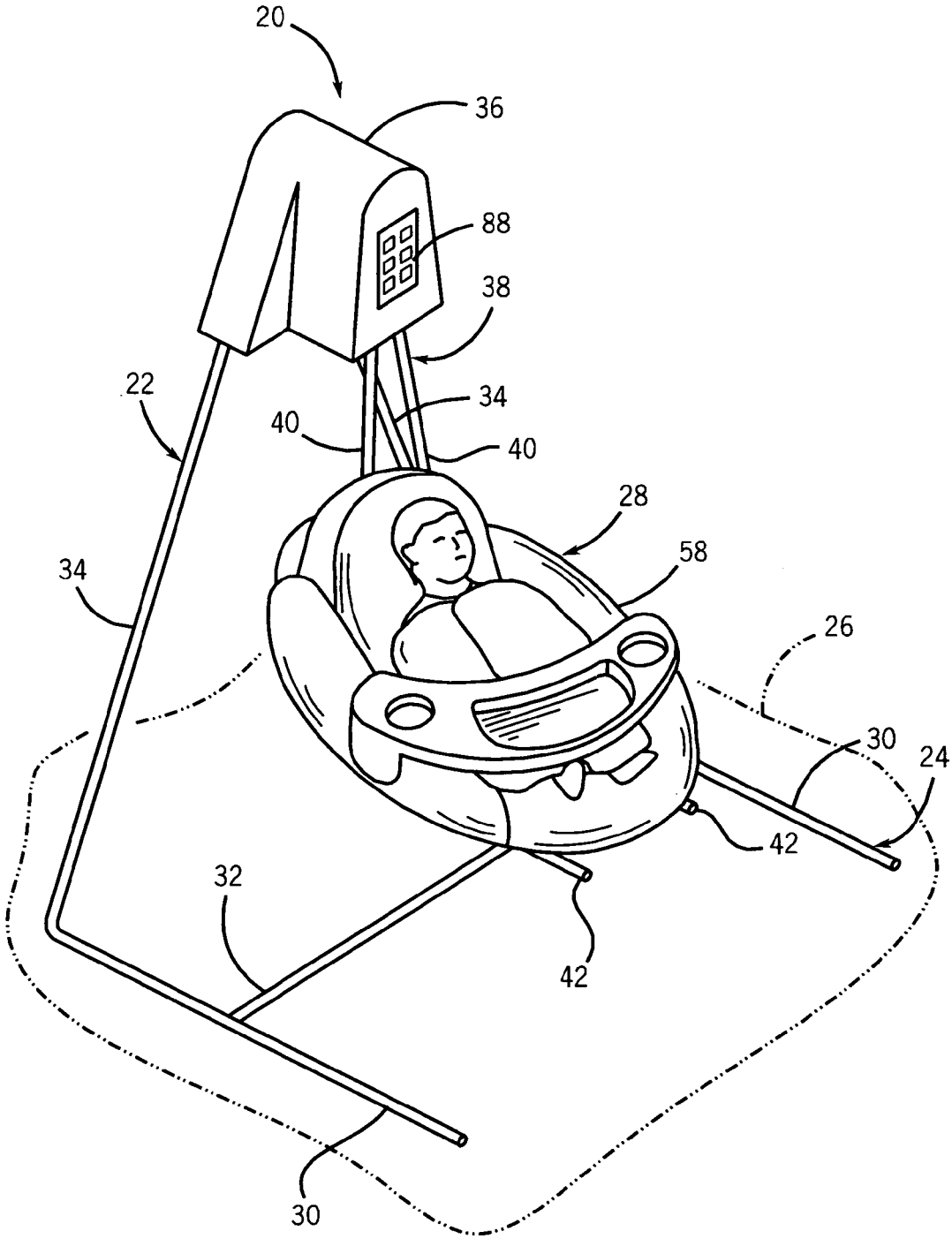
FIG. 3 is a perspective view of the child motion device illustrated in FIG. 1, with the child seat mounted in a different seating orientation.

Accordingly, as illustrated in FIG. 1, the child seat 58 can be orientated to face the direction of seat travel during operation of the device 20 (i.e., the child faces a direction substantially parallel to the direction of seat travel such that the child travels substantially forward and backward). Alternatively, as illustrated in FIG. 3, the child seat 58 can be oriented to face a direction substantially perpendicular to the direction of seat travel during operation of the device (i.e., the child faces a direction substantially perpendicular to the direction of seat travel such that the child travels substantially from side-to-side). Alternatively still, the child seat 58 can swivel about the swivel plate 56 to any desirable position between the positions illustrated in FIGS. 2 and 3. By placing the seat 29 in different orientations on the child motion device 20, the child can experience different relative motions and a variety of different visual environments. The seat assembly 28 can further include any suitable latch mechanism (not shown) to at least temporarily lock the child seat 58 in its desired orientation and prevent unintentional rotation of the seat holder 52 during operation of the device 20.

Figure 4:
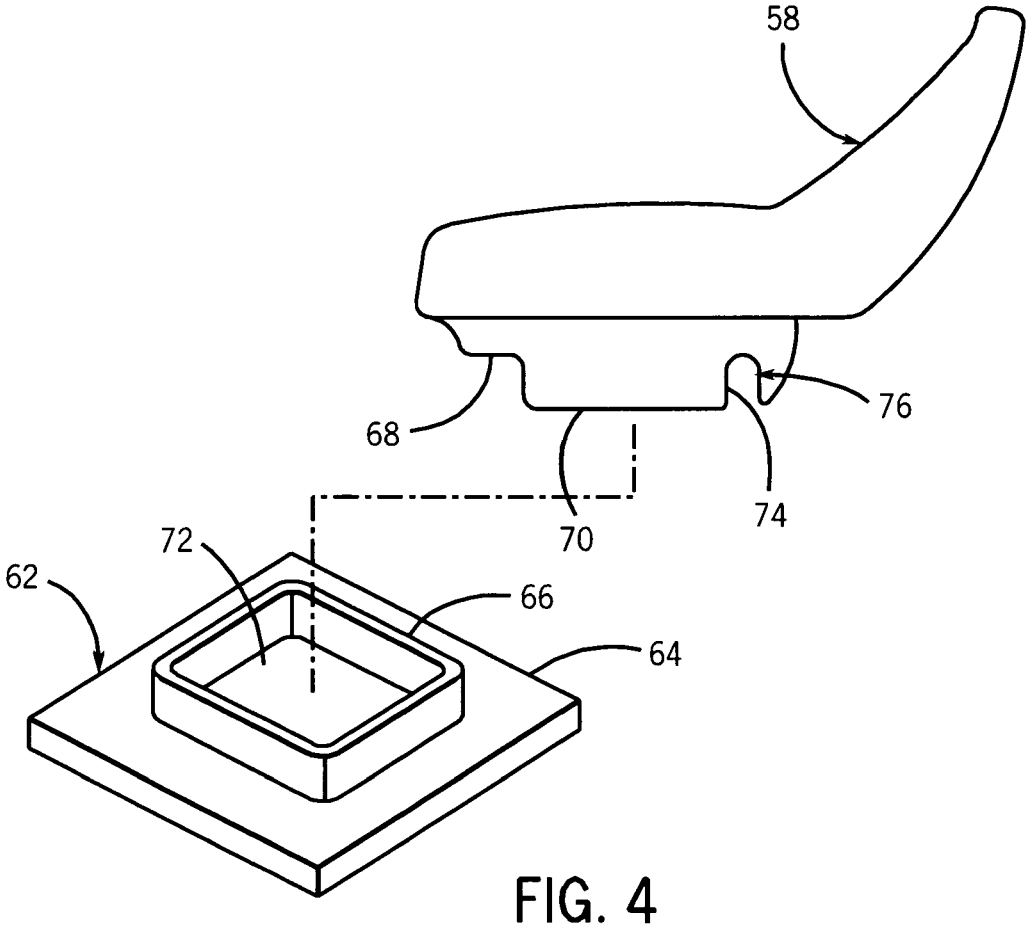
FIG. 4 is an assembly view of a seat assembly constructed in accordance with an alternative embodiment of the present invention.

It should be appreciated that the seat holder 52 is just one example of numerous alternative embodiments that can either support the seat such that the orientation of the seat is adjustable or rigid, and that, unless otherwise noted, the present invention is not limited to the illustrated embodiment. One alternative embodiment is illustrated in FIG. 4, in which a seat holder 62 includes a plate 64 and a square or rectangular shaped frame 66 extending up from the plate 64. The bottom of the child seat 58 can have a flat region 68 on one end that rests on one linear side segment of the frame 66. A depending region 70 of the seat base is sized to fit within an opening 72 of the frame 66. The other end of the base has one or more aligned notches 74 that are configured to receive the opposite linear side segment of the frame 66. The depending region 70 and the notches 74 hold the child seat 58 in place on the frame 66. Gravity alone can be relied upon to retain the seat 58 in position, though in another example, one or more positive manual or automatic latches 76 can be employed in part of the seat, at one or both ends of the seat, as part of the frame 66, and/or at one or both ends of the seat frame 66, to securely hold the child seat 58 in place on the frame 66. The latches 76 can be spring biased to automatically engage when the seat is placed on the frame 66. It should thus be appreciated that the seat 58 can be mounted onto the frame 66 in any one of an array of orientations rotatably offset 90° relative to the base plate 64, including the two orientations illustrated in FIGS. 1 and 3.

Figure 5:
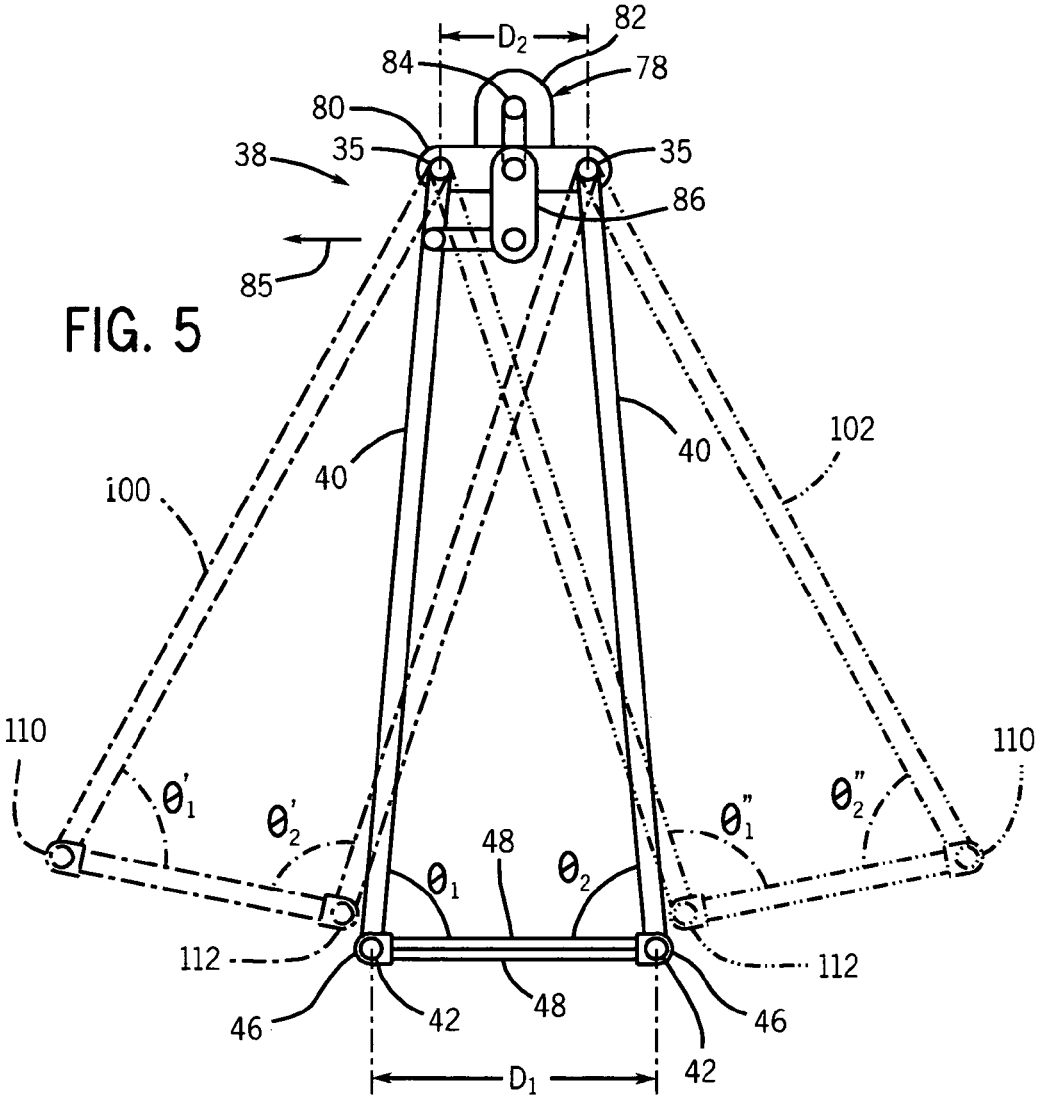
FIG. 5 is a side elevation view of a portion of the child motion device illustrated in FIG. 1 with the child seat assembly removed to illustrate the device in a swinging configuration.

Referring now to FIG. 5, the child motion device 20 further includes a swing support 80 that pivotally supports the proximal ends of the swing arms 40. Specifically, the pivoting proximal ends 35 of the swing arms 40 are spaced a distance "$D_2$" and are pivotally connected to the swing support 80 by a pin, hinge, or the like. It should be appreciated that the proximal ends 35 of the swing arms 40 define the locations on the swing arms 40 that pivot relative to the swing support 80, and that the distance $D_2$ is therefore defined as the distance between the proximal ends 35. However, if the pivot joints of the swing arms 40 were spaced from the proximal ends, the distance $D_2$ would be defined based on the distance between the pivot joints of the swing arms 40. For the purposes of this disclosure, the proximal end 35 is defined as the pivot joint for the swing arms 40.

A drive assembly 78 is configured to drive and oscillate at least one of the swing arms 40 about its proximal end 35. The drive assembly 78 includes a motor 82 that can be supported by the swing support 80 inside the casing 36. The motor 82 has a driven output shaft 84 that is connected to a bell crank 86 that is pivotally connected at one end to the swing support 80 at a location substantially midway between the two proximal ends 35. The opposing end of the bell crank 86 is connected to one of the swing arms 40 at a location spaced from, but adjacent, its proximal end 35. Accordingly, as the output shaft 84 rotates in a given direction, the bell crank 86 biases the swing arm 40 in a driven direction indicated by arrow 85, thus causing the swing arm 40 to pivot about its proximal end 35 accordingly, and the opposing swing arm 40 is likewise passively driven to pivot about its proximal end 35. The drive assembly 78 can be further constructed and configured as described in U.S. Pat. No. 5,525,113, the disclosure of which is hereby incorporated by reference as if set forth in its entirety herein.

The drive assembly 78 can include features that can be manipulated by a user to adjust the amount of angular travel of the driven swing arm 40 relative to the swing support 80, the speed of the movement, and the like. An operator panel, touch pad device, a remote control unit, or user interface can be provided on a portion of the casing 36 with buttons, a touch screen, a keypad, switches, combinations of these features, or the like that a user can manipulate to access, operate, adjust, and alter various performance characteristics of the device. FIGS. 1-3 show one example of a touch pad or screen 88 carried on the vertical front face of the casing 36.

In one example, a user interface with a "cap-touch" or capacitive feedback circuit can be employed. The interface senses a change in capacitance near an electronic part of the device, which can be programmed to trigger a signal to an integrated circuit. The capacitance change signal can be design to trigger based on human contact or contact with a metal object that closely approaches the interface or an electronic board. Many advantages could be achieved by this type of user interface. First, the threshold change level can be designed to be child-proof, i.e., to prohibit a child from altering the product settings or operational mode. Also, the same electronics can be utilized within a motion feedback loop. A metal projection or finger can be coupled to any moving part of the seat and can be positioned to move relative to the electronic board as the support arm moves. The electronics can then track or monitor the arm motion through the relative capacitance changes. This feature could be used for product cycle and motion parameter purposes to control the device.

The present invention recognizes that the swing support 80, the swing arms 40, and the coupler 44 define a geometric configuration that determines the path followed by the child seat assembly 28 during operation of the device 20. It should be appreciated in the illustrated example that the distance $D_2$ between the proximal ends 35 of the swing arms 40 is fixed while the distance $D_1$ between the distal ends 37 of the swing arms is adjustable. Accordingly, the distal ends are said to be "free" even though the adjustability of the distance $D_1$ may be limited in accordance with certain aspects of the present invention.

Figure 6:
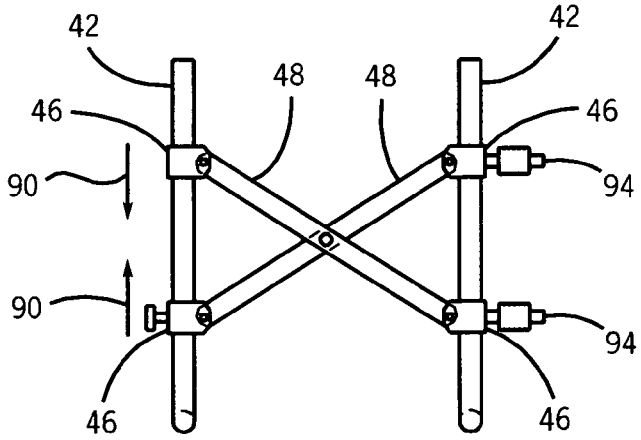
FIG. 6 is a top plan view of a portion of the device as illustrated in FIG. 5.

Referring now to FIGS. 5 and 6, the child motion device 20 is illustrated in a first configuration whereby the coupler 44 produces a distance $D_1$ between the distal ends 37 of the swing arms 40 that is greater than the distance $D_2$ between the proximal ends 35 of the swing arms 40. The distance $D_1$ is adjusted by translating the movable slider members 46 along the support arms 42. Specifically, as the slider members 46 mounted on the same support arm 42 are translated inwardly toward each other along the direction of Arrows 90, the distance between the support arms 42 increases as the angle between the spacer bars 48 and the support arms 42 approaches 90 degrees. Accordingly, in the illustrated embodiment, the distance $D_1$ can be increased to a distance slightly less than the length of the spacer bars 48.

The driven swing arm 40 produces an angle $\theta_1$ relative to a horizontal plane (represented by the spacer bars 48), while the opposing swing arm 40 produces an angle $\theta_2$ relative to the horizontal plane. Assuming the swing arms 40 have a substantially equal length as illustrated, the angles $\theta_1$ and $\theta_2$ are substantially equal, when the swing assembly 38 is in its neutral position, and the seat assembly 28 is orientated along a plane parallel to the horizontal reference plane 26. If the distance $D_1$ between the distal ends 37 had a finite length and the distance $D_2$ between the proximal ends 35 was zero (e.g., the proximal ends 35 intersected), then the swing assembly 38 would approximate the shape of a triangle and the seat assembly 28 would move in a substantially pure swinging motion as the swing arms 40 pivoted about their proximal ends 35. In a pure swinging motion, the orientation of the seat assembly 28 would increasingly deviate from the horizontal reference plane 28 with increasing angular movement of the swing arms 40, and the angles $\theta_1$ and $\theta_2$ would remain constant throughout the movement.

Because the distance $D_2$ between the proximal ends 35 is not zero in the illustrated example, the resulting motion will not be one of pure swinging. However, because the distance D1 is not equal to the distance D2, the motion will have a swinging component when the motor 82 drives the at least one swing arm 40 to oscillate as described above. In accordance with one aspect of the present invention, the motor 82 can drive the swing arm 40 in one direction only (e.g., clockwise rotation about its proximal end 35 shown by phantom lines 100), and then allow gravity to drive the swing arm 40 counterclockwise through the neutral position to a predetermined angle during the second part of the cycle 102 (shown by phantom lines 102) until the counterclockwise inertia is overcome by gravitational forces, which then cause the swing arm 40 to return to its neutral position thereby completing a full cycle, at which time the motor 82 again drives the swing arm 40 to rotate clockwise. Alternatively, the motor 82 can drive the swing arm 40 counterclockwise only, or alternatively still can drive the swing arm in both the clockwise and counterclockwise directions through the entire oscillation. The angle of the partial orbit or arc segment of the swing arms relative to their proximal ends 35 can be less than 150 degrees, and preferably less than 90 degrees (i.e., 45 degrees on either side from the neutral position).

As illustrated in FIG. 5, during one mode of operation, the distance $D_1$ between the distal ends 37 is greater than the distance $D_2$ between the proximal ends 35, and the swing arms 40 are driven to pivot about their proximal ends 35. Accordingly, the distal ends 37 of the swing arms 40 travel through a partial orbit or arc segment of a predetermined angle in a substantially vertical plane. The partial orbit of the swing 40 arms causes the spacer bars 48, which have an orientation that is substantially coplanar with or parallel to the orientation of the seat assembly 28 or, at least, has a predetermined relationship to the orientation of the seat assembly, to move in a predetermined manner.

Specifically, the orientation of the spacer bars 48, which is substantially parallel to the horizontal reference plane 26 when the swing assembly 38 is in its neutral position, changes in response to the angular motion of the swing arms 40 such that the spacer bars 48 are oriented along a plane that intersects with the horizontal reference plane 26. The change of the angular orientation or the spacer bars 48 increases along with increasing angular motion of the swing arms 40. Accordingly, the spacer bars 48, and therefore the seat assembly 28, undergo a swinging or rocking motion when the swing assembly 38 is configured as illustrated in FIGS. 5-6.

The support arms 42 define an outer surface 110 that is defined as being outwardly disposed relative to the inner surface 112 with respect to the neutral position as the swing arms 40 oscillate during operation. Advantageously, when the swing assembly 38 is configured as illustrated in FIGS. 6 and 6 and the motion has a swinging component, the outer surfaces 110 are disposed above the inner surfaces 112 such that the seat assembly 28 is banked in a manner that causes gravitational forces to force the child against the child seat 58.

It should be further noted that in the configuration illustrated in FIGS. 5 and 6, the angles $\theta_1$ and $\theta_2$ change to different angles $\theta_{1'}$ and $\theta_{2'}$ during a first part of the oscillation cycle (indicated by dashed lines 100), and further change to still different angles $\theta_{1''}$ and $\theta_{2''}$ during the second part of the oscillation cycle (indicated by dashed lines 102). The change in angle demonstrates that the motion is not a pure swinging motion, but further includes a gliding component as well. The motion therefore has both a gliding component and a swinging component when the distance $D_1$ between the distal ends 37 is greater than the distance $D_2$ between the proximal ends 35.

The present invention recognizes that as the distance $D_2$ increases relative to the distance D1, the swinging motion characteristic will increase while the gliding motion characteristic will decrease. As a result, the swing assembly 38 can advantageously be adjusted to correspondingly adjust at least one motion characteristic so as to define the desired travel path for the child seat 58. One or more locking pins 92 can be provided to engage with a track or series of holes in the corresponding support arm 42 to fix the position of the slider members 46 in place once they have been moved to their desired locations. A pair of handles 94 can also extend from the slider members 46 that can be grasped by the user when adjusting the position of the slider members 46.

Figure 7:
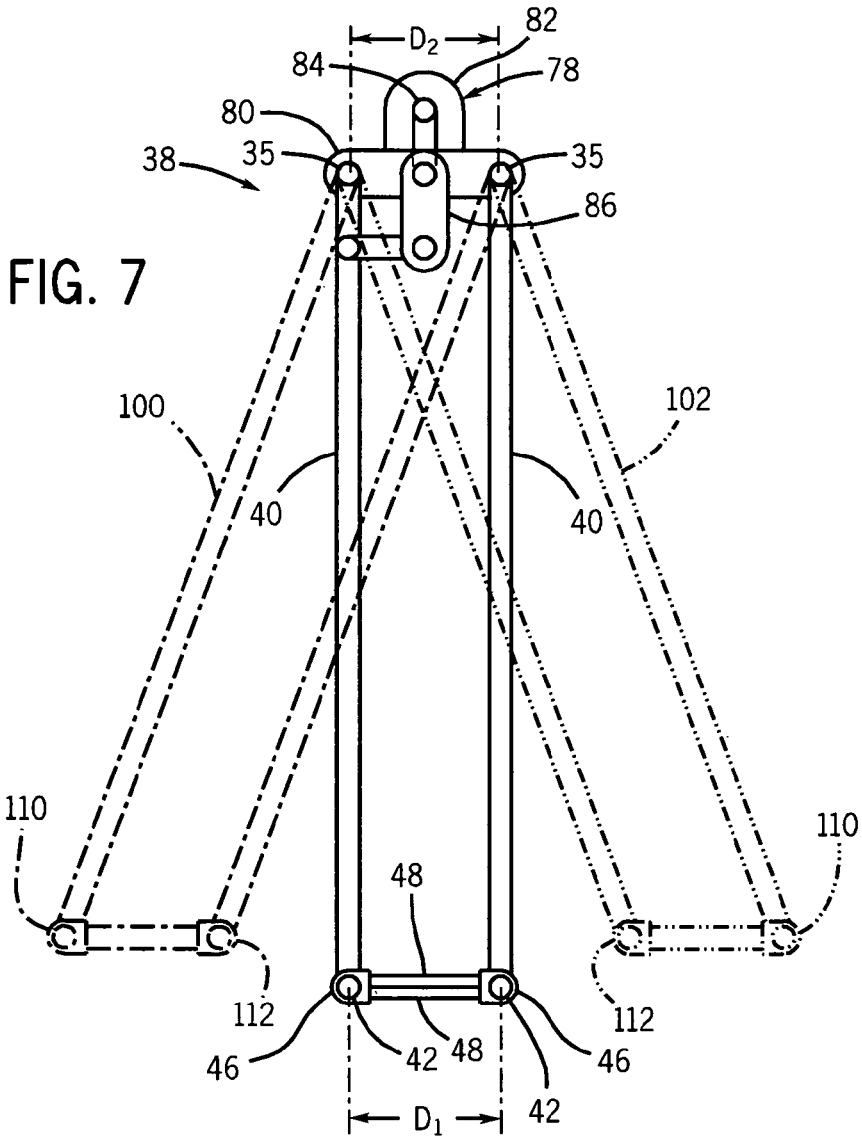
FIG. 7 is a side elevation view of the child motion device illustrated in FIG. 1 with the child seat assembly removed to illustrate the device in a gliding configuration.
Figure 8:
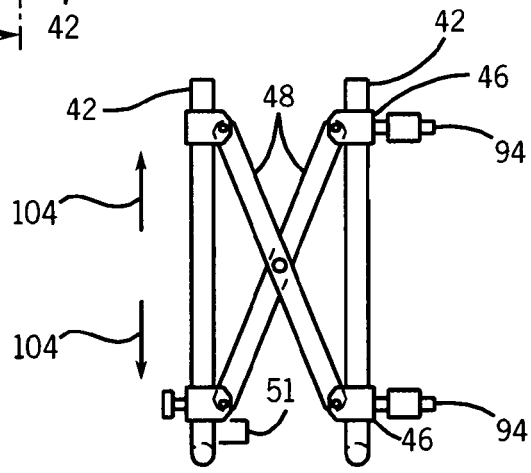
FIG. 8 is a top plan view of a portion of the device illustrated in FIG. 7.

Referring now to FIGS. 7 and 8, in accordance with a second mode of operation, the slider members 46 can be translated outwardly away from each other from their position in FIGS. 5 and 6 along the direction of arrow 104 such that the distance $D_1$ between the distal ends 37 is substantially equal to the distance $D_2$ between the proximal ends 35. Visible markings can be provided on the support arms 42 that align with the slider members 46 and/or a notch can be formed in the support arms 42 to provide visible and/or tactile feedback to the user when the two distances $D_1$ and $D_2$ are equal. When the swing assembly 38 is in its neutral position, the spacer bars 48 extend in an orientation substantially parallel to the horizontal reference plane 26, as described above, and the angles $\theta_1$ and $\theta_2$ are substantially 90 degrees. As the swing arms 40 are driven through their partial orbit about their proximal ends 35, the angles $\theta_{1'}$ and $\theta_{2'}$, and $\theta_{1''}$ and $\theta_{2''}$, are different than $\theta_1$ and $\theta_2$, indicating that the motion of the spacer bars 48 (and thus the supported child seat assembly 29, has a gliding component. Furthermore, the orientation of the spacer bars 48 remains substantially constant (i.e., parallel to the horizontal reference plane 26), indicating that the motion of the spacer bars 48 (and thus the supported child seat assembly, does not have a swinging component). A pure gliding motion is thus produced as the spacer bars 48 travel in a partial orbit about a horizontal axis such that the elevation of the spacer bars 48 changes the reference plane 26 during motion.

While it is theoretically possible to further translate the slider members 46 further inwardly, it may be desirable to provide a lock at the intersection of the spacer bars 48 or a limiter 51 on one of the support arms 42 to prevent a configuration whereby the distance $D_1$ between the distal ends 37 is less than the distance $D_2$ between the proximal ends as such would cause the outer ends 110 to be disposed below the inner ends 112 during the oscillating motion.

Because the coupler 44 determines the distance $D_1$ between the distal ends 37 of the swing arms 40, the coupler 44 is said to be operatively joined to the distal ends 37 of the swing arms 40 even though the coupler may be directly connected to an interposed structure (for instance the seat support arms 42). It should be further appreciated that the distance $D_2$ between the proximal ends 35 of the swing arms 40 relative to the distance $D_1$ of between the distal ends 37 of the swing arms 40 determines the motion characteristics of the seat assembly 28 during operation of the child motion device 20. Accordingly, the distance $D_1$ between distal ends 37 of the swing arm 40 could be fixed while the distance $D_2$ between the proximal ends 35 is adjustable, and that the coupler 44 could thus be configured to vary the distance $D_2$ instead of the distance $D_1$. Alternatively still, both distances $D_1$ and $D_2$ could be adjustable (e.g., adjustable relative to each other) and one or more couplers 44 could vary the distances as desired to thus providing a variable distance between the distal ends 37 and relative to the proximal ends 35. Otherwise stated, one aspect of the present invention allows an absolute difference of the distance $D_1$ between the distal ends 37 and the distance $D_2$ between the proximal ends 35 to be adjusted, thus adjusting the sliding motion component and the gliding motion component that are contributed to the motion of the child seat assembly 28 during operation.

Furthermore, as described above, in all modes of operation, a spring member can be disposed in the seat assembly 28, thus including a bouncer feature to the device 20. In the illustrated example, the spring 60 is captured between the seat holder 52 and the lower surface of the child seat 58. The spring 60 can have a spring constant that causes the child seat 58 to bounce due to the gravitational and inertial forces acting on the child seat assembly 28 due to the motion of the swing arms. Alternatively, a child's motion or a parent's touch can impart a mechanical bouncing motion.

It should be appreciated that the child motion device 20 is constructed according to one aspect of the invention to simulate or mimic various movements that might be employed by a mother or father as they hold a child in their arms. An adult holding a child will often alternate raising and lowering their shoulders to simulate a rocking movement. Other times, the adult may simply sway the child back and forth by laterally moving their elbows from side to side while holding the child to simulate a gliding movement. Sometimes an adult may employ a combination of such movements to simulate a movement having both rocking and gliding components, and may simultaneously gently bounce the baby up and down in sequential vertical movements.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements.

Additional play or entertainment features can also be employed in the disclosed devices. Motion speed options, music and sound options, and other entertainment features can be configured as part of the device. These features can be electronically linked to occur as part of optional, selectable program settings or use modes. For example, a "soothing" setting could be programmed to pre-select music or background sound to accompany a use mode or other product features to create desired characteristics for that setting. Other optional settings can have their own pre-programmed or selectable features as well. Additionally, different play features associated with the devices can be employed in different ways, depending upon the selected child seat orientation. For example, with the seat facing the axis of rotation R of the support arm, the child's field of view will essentially always be the spine and its housing. An entertainment device, a toy, a video screen such as an LCD screen, or the like can be mounted on or part of the housing to entertain the child as they move. Toys or other play features can also be provided as part of or attachable to the child seat 36, if desired.

The details of the various child motion device examples disclosed herein can vary considerably and yet fall within the spirit and scope of the present invention, The construction and materials used to form the frame assembly parts, the spine parts, and the added features can vary from plastics, to steel tubing, to other suitable materials and part structures. The drive system components can also vary, as can the features employed in the drive system to create desired motions and functions for the disclosed devices. The housing can have a top cap that rotates with and/or is integrally a part of the swing arm. Alternatively, the housing can provide a platform on the top or on a side of the spine such that the driven end of the support arm is supported by the platform and rotates relative to the platform.

The child seat bottom or base can be configured so that it engages with the seat holder in any suitable manner. As disclosed herein, vertical or vertically angled notches can be provided in the seat base. The size of the seat holder tubes or other materials can be configured to slip into the notches to engage with the seat. Gravity and the weight of a child can be enough to retain the seat in the holder. However, positive latching structures can be employed if desired. The seat can also be configured to include common features such as a harness system, carrying handles, a pivotable tray, and a hard plastic shell. The base of the seat can have a rocking, bouncing, or stationary support structure configuration and the seat can employ a pad, cover, or other suitable soft goods. As noted above, the seat holder can be configured to hold other devices such as a bassinet or other child supporting device.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device. In another example, the child seat could be fixed to the support arm and not removable.

Also, though not shown in detail herein, each foldable joint of the frame assemblies can have positive locking or detent mechanisms to retain or lock the devices in either or both the in-use and the folded configurations. The joints can be gear-type joints, a combination of spring biased locking pins, pivot joints, and apertures, or other latching mechanisms. Alternatively, the devices disclosed herein need not be foldable at all, if desired, but instead can be constructed so that they can not be collapsed without disassembly of the components. Quick disconnect joints can be employed so that the device can be easily broken down for transport or storage. The seat holder can even be separately detachable and replaceable with other seat holders of different configuration to accommodate different child supporting devices, if desired.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

What is claimed is:

1. A child motion device comprising:

a frame supported by a surface;

a swing assembly supported by the frame at a location spaced from the support surface, the swing assembly having a pair of swing arms that pivot about proximal ends coupled to the frame and that support the child seat holder at distal ends, wherein a distance between the distal ends is adjustable; and a child seat holder supported by the swing assembly for movement thereon, wherein the swing assembly has a motion characteristic capable of including an adjustable gliding component and an adjustable swinging component, each being adjustable by adjusting the distance between the distal ends, and the swing assembly drives the child seat holder along a travel path having the motion characteristic.

2. The child motion device as recited in claim 1, wherein the motion characteristic comprises a pure gliding motion.

3. The child motion device as recited in claim 1, wherein the child seat holder is driven through an arc segment by the swing assembly.

4. The child motion device as recited in claim 1, further comprising a coupler operatively joined to the distal ends, the coupler having two pairs of slider members, each pair being movably supported by each of the distal ends respectively, and a pair of intersecting spacer bars connecting the slider members to define an adjustable distance between the slider member pairs.

5. The child motion device as recited in claim 1, further comprising a drive system connected to the swing assembly.

6. The child motion device as recited in claim 1, further comprising a child seat assembly supported by the child seat holder.

7. A child motion device comprising:

a frame supported by a surface;

a swing assembly supported by the frame at a location spaced from the support surface; and a child seat holder supported by the swing assembly for movement thereon, wherein the swing assembly comprises a pair of swing arms that pivot about their proximal ends and that support the child seat holder at their distal ends, wherein the proximal ends have a first distance therebetween, and wherein the distal ends have a second distance therebetween, and wherein the first and second distances define a difference that is adjustable.

8. A child motion device comprising:

a frame supported by a surface;

a swing assembly supported by the frame at a location spaced from the support surface and having a pair of swing arms with proximal ends coupled to the frame and distal ends;

a child seat holder supported by the distal ends for movement thereon; and a coupler operatively joined to the distal ends, wherein the coupler further comprises two pairs of slider members, each pair being movably supported by each of the distal ends respectively, and a pair of intersecting spacer bars connecting the slider members to define an adjustable distance between the slider member pairs.

9. The child motion device as recited in claim 8, wherein at least one slider member of each pair is movable relative to the other slider member of the pair to adjust the distance between the slider member pairs.

10. The child motion device as recited in claim 9, further comprising a pair of support arms extending from the swing arms, wherein the support arms support the child seat holder, and wherein the slider members are mounted onto the support arms.

11. The child motion device as recited in claim 10, wherein the support arms extend from the distal ends of the swing arms.

12. The child motion device as recited in claim 7, wherein the child seat holder is configured to receive and support a child seat in more than one optionally selectable seat facing orientation, and wherein the child seat can be oriented in a first seat facing orientation such that the child seat oscillates forward and backward as the swing arm pivots and a second seat facing orientation such that the child seat oscillates side to side as the swing arm pivots.

13. The child motion device as recited in claim 7, wherein the difference is substantially zero such that the motion characteristic is a substantially pure gliding motion.

14. The child motion device as recited in claim 7, wherein the second distance is greater than the first distance and an increasing distance produces an increasing swinging component to the motion characteristic.

15. The child motion device as recited in claim 7, further comprising a lock preventing the second distance from being smaller than the first distance.

16. The child motion device as recited in claim 7, further comprising a pair of support arms extending from the distal ends, wherein the support arms support the child holder.

17. The child motion device as recited in claim 7, further comprising a pair of support arms extending from the distal ends, wherein the support arms support the child seat assembly.

* * * * *